US010232985B2

(12) United States Patent
Bisio

(10) Patent No.: US 10,232,985 B2
(45) Date of Patent: Mar. 19, 2019

(54) CAP FOR CONTAINER PROVIDED WITH GUARANTEE SEAL

(71) Applicant: GUALA PACK S.p.A., Castellazzo Bormida (IT)

(72) Inventor: Luigi Bisio, Alessandria (IT)

(73) Assignee: GUALA PACK S.p.A., Castellazzo Bormida (IT)

( * ) Notice: Subject to any disclaimer, the term of this patent is extended or adjusted under 35 U.S.C. 154(b) by 356 days.

(21) Appl. No.: 14/941,786

(22) Filed: Nov. 16, 2015

(65) Prior Publication Data

US 2016/0068310 A1 Mar. 10, 2016

Related U.S. Application Data

(63) Continuation of application No. 13/971,866, filed on Aug. 21, 2013, now Pat. No. 9,187,217, which is a continuation of application No. 12/422,553, filed on Apr. 13, 2009, now Pat. No. 8,528,757, which is a continuation of application No. PCT/IT2007/000426, filed on Jun. 15, 2007.

(51) Int. Cl.

| | |
|---|---|
| ***B65D 53/00*** | (2006.01) |
| ***B65D 41/34*** | (2006.01) |
| ***B65D 75/58*** | (2006.01) |

(52) U.S. Cl.

CPC ..... *B65D 41/3433* (2013.01); *B65D 41/3404* (2013.01); *B65D 75/5883* (2013.01)

(58) Field of Classification Search

CPC ..... B65D 41/3404; B65D 41/3433; B65D 41/5883

USPC ..... 220/304; 215/252, 307, 258

See application file for complete search history.

(56) References Cited

U.S. PATENT DOCUMENTS

| | | | |
|---|---|---|---|
| 1,981,414 | A | 11/1934 | Hermani |
| D199,440 | S | 10/1964 | Jones et al. |
| D204,961 | S | 5/1966 | Kossnai |

(Continued)

FOREIGN PATENT DOCUMENTS

| | | | |
|---|---|---|---|
| CH | 642321 | C | 3/1937 |
| EP | 0688724 | A1 | 12/1995 |

(Continued)

OTHER PUBLICATIONS

Communication issued by the European Patent Office dated Dec. 5, 2013 concerning the observations by a third party concerning the patentability of corresponding European Patent Application No. 07790158 (7 pages).

(Continued)

*Primary Examiner* — Anthony Stashick
*Assistant Examiner* — James Way
(74) *Attorney, Agent, or Firm* — Harness, Dickey & Pierce, P.L.C.

(57) ABSTRACT

The object of the present invention is a cap provided with a guarantee seal. The guarantee seal consists of guarantee portions comprising an engagement portion and a connecting portion. The seal further comprises bridges for connecting adjacent guarantee portions to one another and a safety portion that makes the engagement portion integral with the handling portion. The safety portion is structurally suitable for keeping the engagement portion constrained in the broken seal configuration, for preventing the forming of dangerous spikes.

28 Claims, 6 Drawing Sheets

(56) References Cited

U.S. PATENT DOCUMENTS

| | | | | |
|---|---|---|---|---|
| D209,788 | S | 1/1968 | Cheladze | |
| 3,601,273 | A | 8/1971 | Kutcher | |
| 3,767,077 | A | 10/1973 | Rhoades | |
| 3,770,156 | A | 11/1973 | Yates, Jr. | |
| 3,812,991 | A | 5/1974 | Wurl | |
| 4,305,516 | A | 12/1981 | Perne et al. | |
| 4,480,761 | A | 11/1984 | Aichinger | |
| 4,529,096 | A | 7/1985 | Chartier et al. | |
| 4,567,991 | A * | 2/1986 | Anderson | B65D 41/3409 215/216 |
| 4,669,124 | A | 5/1987 | Kimura | |
| 4,744,479 | A | 5/1988 | Schottli | |
| 4,744,480 | A | 5/1988 | Luch et al. | |
| 4,796,770 | A | 1/1989 | Begley | |
| 4,813,562 | A | 3/1989 | Begley | |
| D301,690 | S | 6/1989 | Mobberley | |
| 4,844,272 | A | 7/1989 | Dutt | |
| D316,969 | S | 5/1991 | Wiseman et al. | |
| 5,040,692 | A | 8/1991 | Julian | |
| 5,056,675 | A | 10/1991 | Julian | |
| 5,080,246 | A | 1/1992 | Hayes | |
| 5,249,704 | A | 10/1993 | Boetzkes | |
| 5,307,949 | A | 5/1994 | Von Holdt, Jr. | |
| 5,361,919 | A | 11/1994 | Hull et al. | |
| 5,648,037 | A | 7/1997 | Franchet et al. | |
| 5,716,152 | A | 2/1998 | Kudo | |
| 5,791,509 | A | 8/1998 | Rush et al. | |
| 5,853,095 | A | 12/1998 | Marshall et al. | |
| 5,915,576 | A | 6/1999 | Robinson | |
| 5,992,661 | A | 11/1999 | Zumbuhl | |
| 6,202,871 | B1 | 3/2001 | Kelly | |
| D445,679 | S | 7/2001 | Malmborg | |
| 6,264,052 | B1 | 7/2001 | Schmitz | |
| 6,296,541 | B1 | 10/2001 | Bezalel et al. | |
| 6,327,770 | B1 | 12/2001 | Konefal et al. | |
| D467,501 | S | 12/2002 | Tacchella | |
| 6,581,792 | B1 | 6/2003 | Limanjaya | |
| 6,599,460 | B1 | 7/2003 | Brown et al. | |
| 6,604,647 | B1 | 8/2003 | Luburic | |
| 6,685,061 | B2 | 2/2004 | Wolf et al. | |
| 6,729,488 | B2 | 5/2004 | McNary et al. | |
| 6,811,047 | B1 | 11/2004 | Hicks et al. | |
| D520,874 | S | 5/2006 | Gross et al. | |
| 7,097,058 | B2 | 8/2006 | Wellman et al. | |
| D529,382 | S | 10/2006 | Mineau | |
| D531,503 | S | 11/2006 | Beaver et al. | |
| D547,657 | S | 7/2007 | Tacchella | |
| D552,483 | S | 10/2007 | Rigardo | |
| D566,640 | S | 4/2008 | Holz et al. | |
| 7,413,097 | B1 | 8/2008 | Adams | |
| D588,870 | S | 3/2009 | Rasmussen | |
| 7,513,377 | B1 | 4/2009 | Culley | |
| 7,575,123 | B2 | 8/2009 | Laveault et al. | |
| D610,456 | S | 2/2010 | Rognard | |
| D637,080 | S | 5/2011 | Brooks | |
| D637,907 | S | 5/2011 | Maxa et al. | |
| D657,244 | S | 4/2012 | Priebe et al. | |
| 8,205,761 | B2 | 6/2012 | Stull, Sr. et al. | |
| D679,597 | S | 4/2013 | Tamarindo | |
| 8,528,757 | B2 | 9/2013 | Bisio | |
| 9,016,473 | B2 | 4/2015 | Tamarindo | |
| 9,187,217 | B2 | 11/2015 | Bisio | |
| 2001/0047994 | A1 | 12/2001 | von Holdt | |
| 2002/0088814 | A1 | 7/2002 | Belfance et al. | |
| 2004/0200797 | A1 | 10/2004 | Hicks et al. | |
| 2005/0011911 | A1 | 1/2005 | Vaughan | |
| 2005/0045578 | A1 | 3/2005 | Schwarz et al. | |
| 2006/0043056 | A1 | 3/2006 | Lee | |
| 2007/0029325 | A1 | 2/2007 | Herold | |
| 2008/0078760 | A1 | 4/2008 | Auer et al. | |
| 2008/0087625 | A1 | 4/2008 | Kumata et al. | |
| 2009/0152269 | A1 | 6/2009 | Pucci | |
| 2009/0223963 | A1 | 9/2009 | Bisio | |
| 2009/0229481 | A1 | 9/2009 | Patterson | |
| 2014/0048536 | A1 | 2/2014 | Bisio | |

FOREIGN PATENT DOCUMENTS

| | | | |
|---|---|---|---|
| EP | 1407977 | A1 | 4/2004 |
| EP | 1676783 | A1 | 7/2006 |
| GB | 2410493 | A | 8/2005 |
| JP | 10-181758 | | 7/1998 |
| JP | 2002104447 | A | 4/2002 |
| JP | 2004-231229 | A | 8/2004 |
| JP | 2004-331124 | A | 11/2004 |
| WO | WO-95/028334 | A1 | 10/1995 |
| WO | WO-9948582 | A1 | 9/1999 |
| WO | WO-9967151 | A1 | 12/1999 |
| WO | WO-2004045977 | A1 | 6/2004 |
| WO | WO-2004108545 | A1 | 12/2004 |
| WO | WO-2008050361 | A1 | 5/2008 |

OTHER PUBLICATIONS

Communication issued by the European Patent Office dated Feb. 10, 2012 concerning the observations by a third party concerning the patentability of corresponding European Patent Application No. 07790158 (9 pages).

Communication issued by the European Patent Office dated Oct. 2, 2012 concerning the observations by a third party concerning the patentability of corresponding European Patent Application No. 07790158 (8 pages).

International Search Report received in corresponding International Patent Application No. PCT/IT2007/000426 dated Oct. 22, 2007 (3 pages).

Response to the observations by a third party filed with the European Patent Office dated Mar. 8, 2012 (2 pages).

Response to the observations by a third party filed with the European Patent Office dated Oct. 31, 2012 concerning European Patent Application No. 07790158 (1 page).

FDA Tamper Resistant Packaging Guide "FDA Compliance Policy Guides Section 450.500 Tamper Resistant Packaging Requirements" revised May 21, 1992.

Petition for Inter Partes Review by KSP of U.S. Pat. No. 8,528,757 dated May 19, 2016.

Declaration of Howard Leary in Support of Petition for Inter Partes Review.

* cited by examiner

CAP FOR CONTAINER PROVIDED WITH GUARANTEE SEAL

CROSS-REFERENCE TO RELATED APPLICATIONS

This application is a continuation of U.S. patent application Ser. No. 13/971,866 filed on Aug. 21, 2013, which is a continuation of U.S. patent application Ser. No. 12/422,553 filed on Apr. 13, 2009, now U.S. Pat. No. 8,528,757 issued on Sep. 10, 2013, which is a continuation of PCT/IT2007/000426 filed on Jun. 15, 2007, which claims priority to Italian Patent Application No. ITSN BS2006A000190 filed on Oct. 27, 2006. The entire disclosures of each of the above application are incorporated herein by reference.

FIELD

The present invention relates to a cap for container with guarantee seal, that is a cap provided with a seal which upon the first opening, undergoes breakage, thus indicating the occurrence of the opening or tampering of the container.

BACKGROUND

This section provides background information related to the present disclosure which is not necessarily prior art.

As known, caps with guarantee seal have become much widespread since they allow the consumer to ensure that the container has not been already opened or tampered. Such guarantee is especially appreciated in the field of containers for alimentary pastas or liquids, for example fruit juices, wherein the opening of the container could cause the deterioration of the contents or sometimes, the introduction of undesired substances in the container.

Fruit juice containers, in particular, are normally used by children, so a set of more or less strict standards according to the country, prescribe some safety is requirements the caps must meet.

The standards usually impose some restrictions on the cap dimensions so as to prevent the possibility that they are swallowed by the children.

For the caps currently known, once the cap is unscrewed the guarantee seal breaks into a set of portions that remain associated to the cap body, so the possibility that such portions are swallowed by the children should be substantially prevented.

However, besides being weakly associated to the cap body, they form spikes that dangerously protrude from the cap body. The spikes could harm hurt the child's eyes or they could be detached from the cap body with the teeth and swallowed.

SUMMARY

This section provides a general summary of the disclosure, and is not a comprehensive disclosure of its full scope or all of its features.

The object of the present invention is to make a cap for containers provided with a guarantee seal which should be especially safe to be used even by children.

Such object is achieved by a cap suitable for being associated to a coupling portion of a container and suitable for being disconnected by rotation about an axis of rotation from the coupling portion. The coupling portion comprises resistant elements suitable for engaging the cap.

The cap comprises a handling portion, suitable for being rotated by a user for disconnecting the cap from the container, and a guarantee seal, integral with the handling portion and comprising a plurality of guarantee portions, wherein the seal has breaks in a broken seal configuration.

At least one of the guarantee portions comprises an engagement portion, having at least one engagement element suitable for engaging with the resistant elements of the coupling portion for preventing the rotation of the guarantee seal, and a connecting portion, connected to the engagement portion, having at least one connecting element which makes the connecting portion integral to the handling portion.

The guarantee seal comprises at least one bridge which connects adjacent guarantee portions to one another, the bridge being suitable for breaking by rotation of the handling portion relative to the guarantee seal.

The guarantee seal further comprises a safety portion that makes the engagement portion integral with the handling portion, the safety portion being structurally suitable for keeping the engagement portion constrained in the broken seal configuration.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
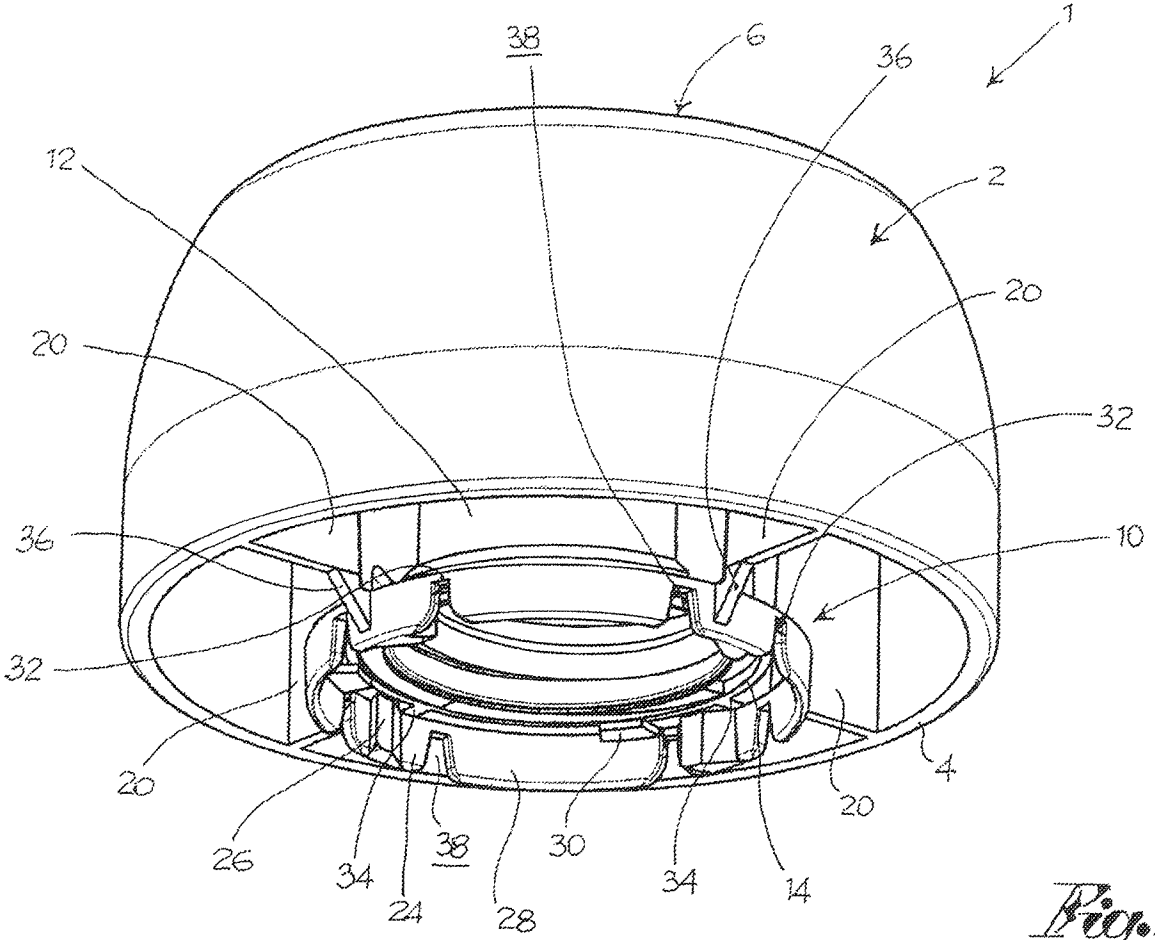
FIG. 1 shows a perspective bottom view of the cap according to the present invention, provided with a guarantee seal in an intact seal configuration.
Figure 2:
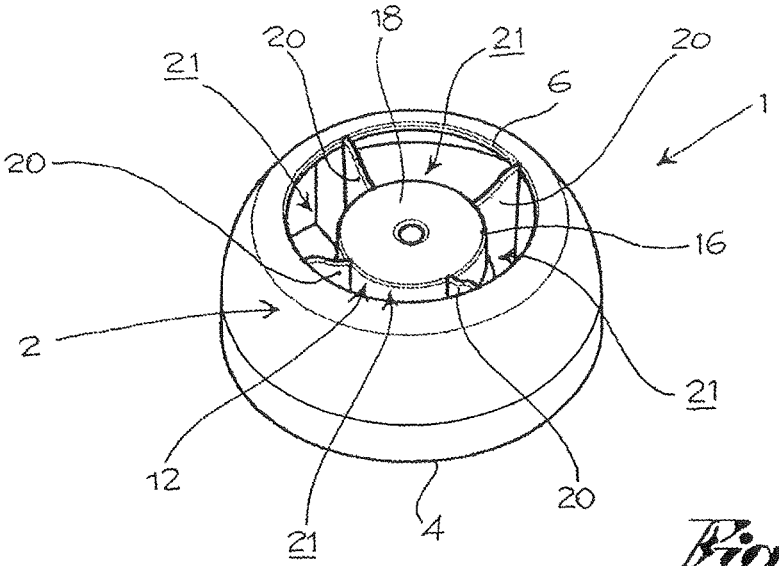
FIG. 2 shows a further perspective view of the cap of FIG. 1.
Figure 3:
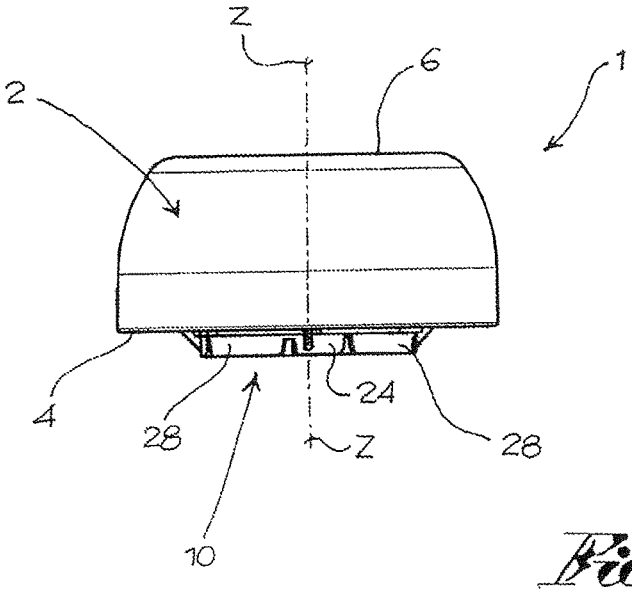
FIG. 3 shows a plan side view of the cap of FIG. 2.
Figure 4:
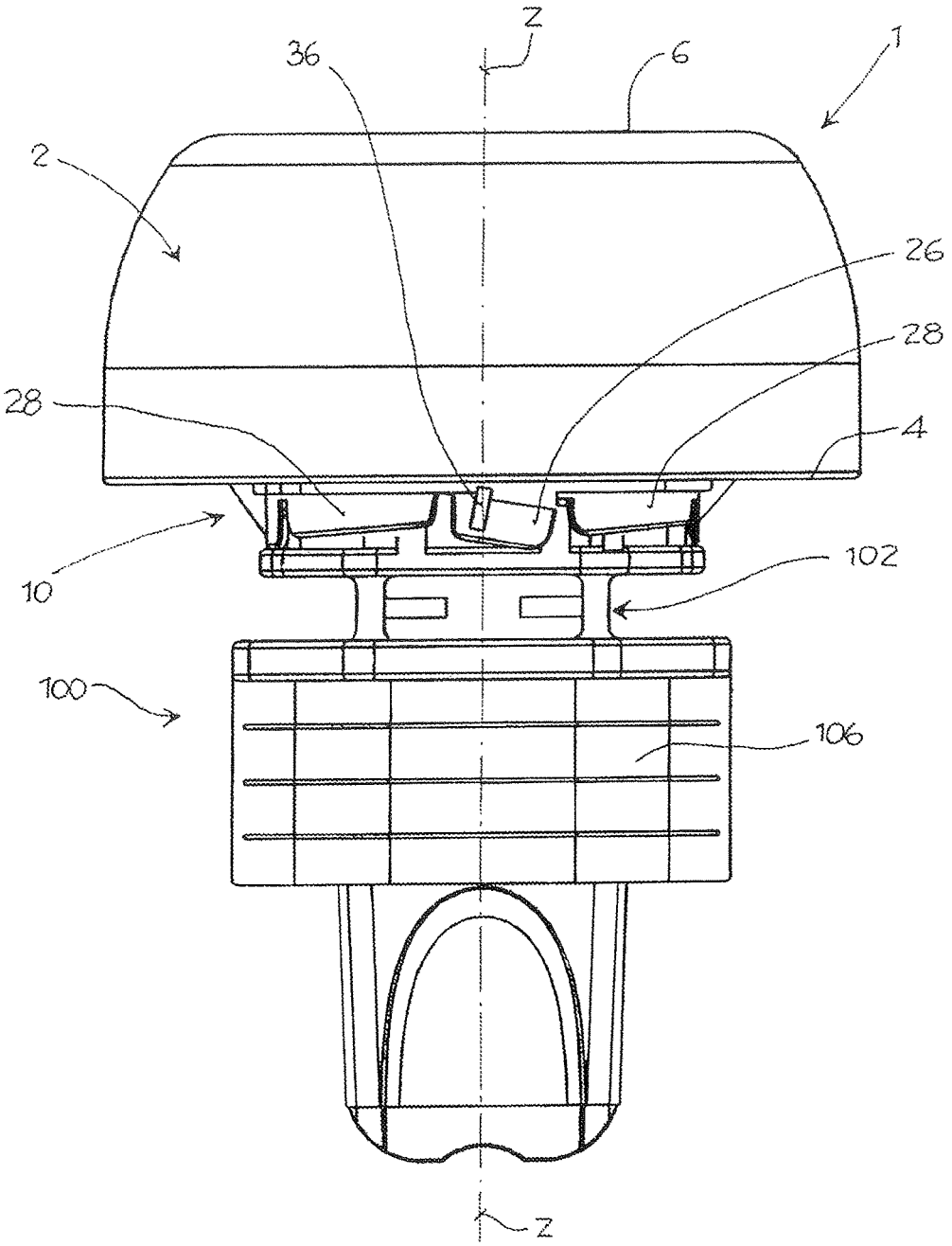
FIG. 4 shows a closing device comprising the cap according to the present invention and a coupling portion to the container, wherein the guarantee seal is in an incipient breakage configuration.
Figure 5:
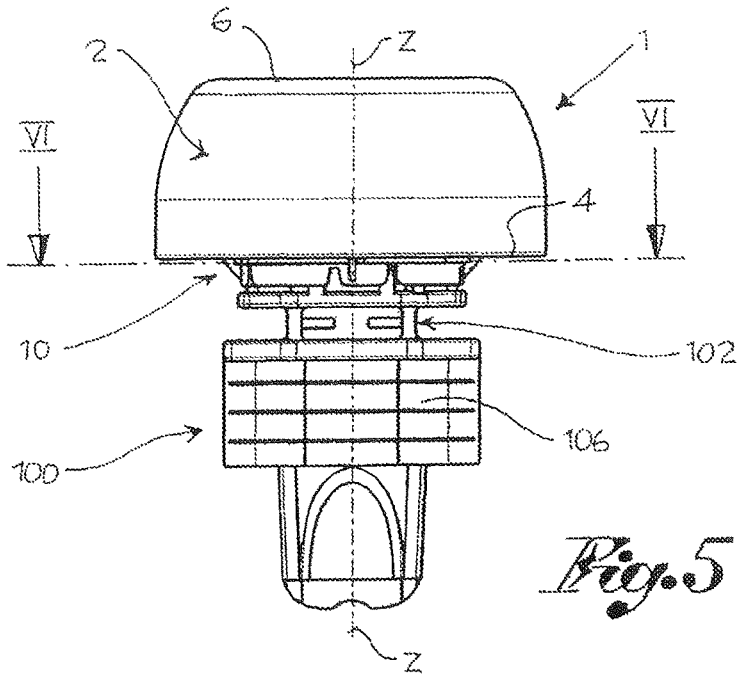
FIG. 5 shows the closing device of FIG. 4 in an intact seal configuration.
Figure 6:
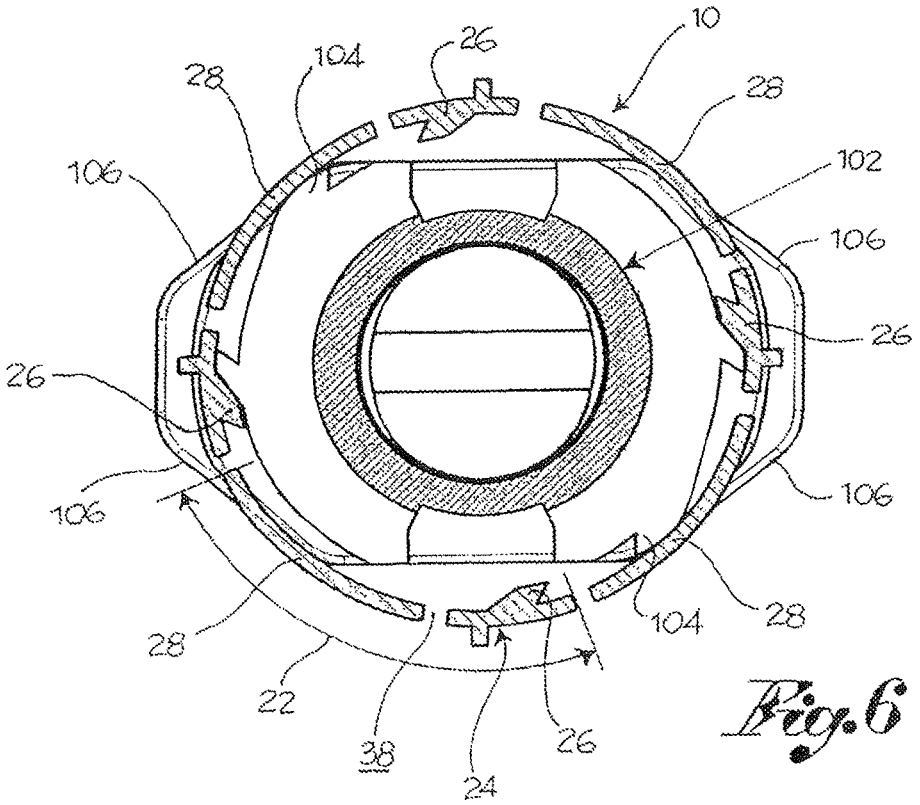
FIG. 6 shows a section view obtained according to line VI-VI of FIG. 5.
Figure 7:
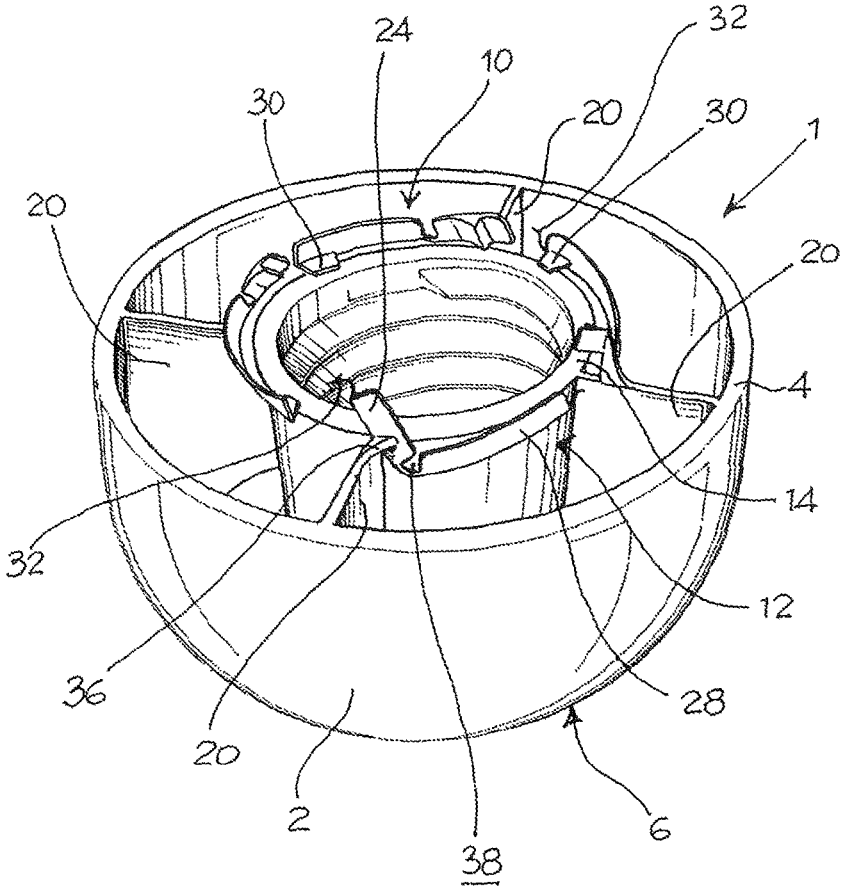
FIG. 7 shows a perspective view of the cap according to the present invention, in a broken seal configuration. Corresponding reference numerals indicate corresponding parts throughout the several views of the drawings.
Figure 8:
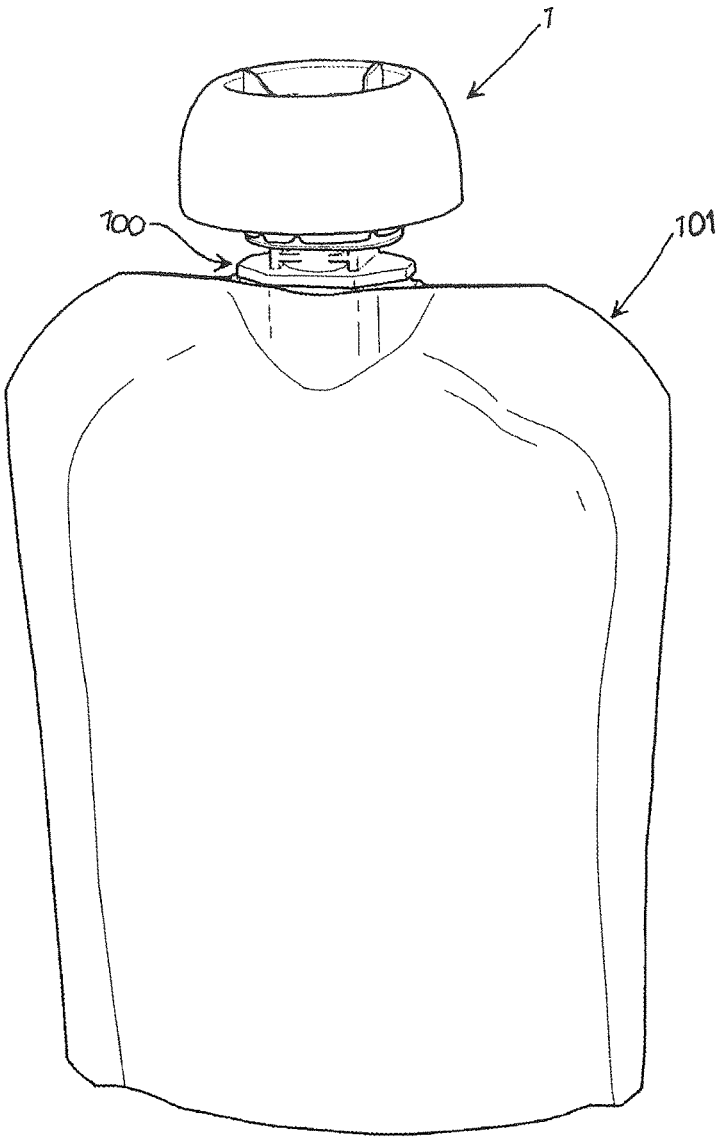
FIG. 8 shows a perspective view of the cap, coupling portion, and container according to the present invention.

Example embodiments will now be described more fully with reference to the accompanying drawings.

With reference to the annexed figures, reference numeral 1 globally indicates a cap suitable for being associated to a coupling portion 100 of a container 101, preferably deformable.

The coupling portion 100 of the container is generally provided with a tubular straw 102, for dispensing the contents from the container, to which the cap is associable.

At the base of straw 102, the coupling portion 100 comprises at least one resistant element 104 suitable for engaging the cap for preventing the rotation thereof, at least upon the first opening of the container.

According to a preferred embodiment, the coupling portion 100 further comprises welding walls 106 for welding the coupling portion 100 to the container walls.

Cap 1 is suitable for being disconnected from the coupling portion 100 of the container, generally by rotation about an axis of rotation Z-Z, and comprises a guarantee seal 10 which, upon the first opening of the container, that is, upon the first unscrewing of cap 1 from the coupling portion 100, undergoes breakage that proves the occurrence of the opening.

Cap 1 comprises a handling portion 2 suitable for being rotated by a user for disconnecting cap 1 from the container.

According to a preferred embodiment, the handling portion 2 extends axially from a bottom edge 4, close to the guarantee seal 10, to an upper edge 6. In particular, the guarantee seal 10 axially protrudes underneath the lower edge 4 of the handling portion 2.

Preferably, moreover, the lower edge 4 of the handling portion 2 radially extends externally to the guarantee seal 10.

According to a preferred embodiment, moreover, cap 1 comprises an inner annular wall 12, for example internally threaded for allowing the screwing and/or unscrewing of cap 1 from the coupling portion 100.

The inner annular wall 12 axially extends between a lower edge 14, close to the guarantee seal 10, and an upper edge 16.

Cap 1 further comprises a closing bottom 18, arranged at the upper edge 16 of the inner annular wall 12, for closing thereof and thereby the container.

According to a preferred embodiment, moreover, cap 1 comprises at least one tongue 20, for example flat, arranged on a longitudinal plane passing by the axis of rotation Z-Z of the cap. In particular, cap 1 comprises four tongues 20, arranged angularly equally spaced.

The tongues 20 connect the handling portion 2 to the inner annular wall 12.

According to a preferred embodiment, the cap comprises safety passages 21 passing through the outer enclosure of the cap, for example through the handling portion 2.

Advantageously, the safety passages allow the passage of air through the handling portion in the event the cap, while meeting the strictest standards envisaged on this subject, is accidentally swallowed.

According to a preferred embodiment, the safety passages 21 are obtained between the tongues 20 for the connection between the handling portion 2 and the inner annular wall 12.

The guarantee seal 10, which extends as a tape annularly about the axis of rotation Z-Z, comprises a plurality of guarantee portions 22, connected to one another in an intact seal configuration, that is, prior to the first opening of the container, and separate from each other in a broken seal configuration, that is, after the first opening of the container.

The guarantee portion 22 comprises an engagement portion 24 having at least one engagement element 26 suitable for engaging with the resistant elements 104 of the coupling portion 100, for preventing the rotation of the guarantee seal.

Moreover, the guarantee portion 22 comprises a connecting portion 28, connected to the engagement portion 24 and having at least one connecting element 30 which makes the connecting portion 28 integral to the handling portion 2.

Moreover, the guarantee seal comprises at least one bridge 32 that connects the guarantee portions 22 to one another. The bridge 32 is suitable for breaking by rotation of the handling portion 2 relative to the guarantee seal 10.

The guarantee seal 22 further comprises a safety portion 34 that makes the engagement portion 24 integral with the handling portion 2. The safety portion 34 is structurally suitable for keeping the engagement portion 24 connected to the handling portion 2 in the broken seal configuration.

In other words, even when the guarantee seal undergoes breakage, thus indicating the occurrence of the opening of the container, the safety portion 34 keeps the engagement portion 24 constrained, so as not to form dangerous spikes.

Moreover, for higher safety, according to a preferred embodiment, the safety portion 34 comprises a reinforcing element 36 that connects the safety portion 34 to tongue 20.

Preferably, moreover, a loop 38 is obtained between the engagement portion 24 and the connecting portion 28, which advantageously allows settling the engagement portion 24 and the connecting portion 28 in the broken seal configuration.

Innovatively, the cap according to the present invention is especially safe, especially to be used by children.

In particular, even when detached from one another due to the tearing undergone by the bridges which makes them break, the guarantee portions maintain a limited length, so as not to form dangerous spikes.

Advantageously, moreover, the guarantee portions are strongly constrained to the inner annular wall, so as to not be torn away, for example with the mouth.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A cap for use with a coupling portion of a container and suitable for being disconnected upon rotation relative to the coupling portion, the cap comprising:

an inner annular wall extending from a lower edge to an upper edge;

a closing bottom at the upper edge to close the inner annular wall;

a handling portion suitable to be grasped by a user to disconnect the cap from the coupling portion, the handling portion extending from a bottom edge to a top edge, the bottom edge of the handling portion being coplanar with the lower edge of the inner annular wall; and a guarantee seal extending from an upper guarantee seal edge to a lower guarantee seal edge having, at least one engagement element having a vertically extending engagement face extending substantially from the upper guarantee seal edge toward the lower guarantee seal edge and configured to rotationally engage a resistant element of the coupling portion, at least one bridge connecting adjacent portions of the guarantee seal and configured to break upon the vertically extending engagement face of the at least one engagement element rotationally engaging the resistant element of the coupling portion, and a safety portion connecting the inner annular wall to the guarantee seal to retain the guarantee seal such that the guarantee seal remains attached to the cap upon breaking of the bridge.

2. The cap of claim 1, wherein the handling portion extends between a bottom edge and a top edge and is radially spaced from the inner annular wall to define at least one safety passage between the handling portion and the inner annular wall.

3. The cap of claim 2, further comprising at least one tongue connecting the handling portion to the inner annular wall.

4. The cap of claim 3, wherein the tongue extends generally radially from the inner annular wall to the handling portion and the safety portion is positioned adjacent the tongue.

5. The cap of claim 4, wherein the safety portion further includes a reinforcing element extending between the safety portion and the tongue that connects the safety portion to the tongue.

6. The cap of claim 1, further comprising the coupling portion having a tubular straw.

7. The cap of claim 6, further comprising the container attached to the coupling portion.

8. The cap of claim 1, wherein the bottom edge of the handling portion radially extends externally to the guarantee seal.

9. The cap of claim 3, wherein the at least one tongue includes four equally spaced tongues extending about the inner annular wall to the handling portion.

10. The cap of claim 1, wherein the guarantee seal includes a plurality of guarantee portions, each guarantee portion having at least one engagement element.

11. The cap of claim 1, wherein the guarantee seal includes at least one guarantee portion having an engagement portion having the at least one engagement element and a connecting portion, wherein the safety portion is adjacent the engagement portion.

12. The cap of claim 11, further comprising a loop between the engagement portion and the connecting portion of the guarantee seal for settling the engagement portion and the connecting portion upon breakage of the bridge.

13. The cap of claim 7, wherein the container is deformable.

14. The cap of claim 1, wherein the guarantee seal includes a plurality of guarantee portions connected to one another in an intact seal configuration prior to a first opening of the container and separate from each other in a broken seal configuration after the first opening of the container.

15. The cap of claim 2, wherein the guarantee seal extends below the lower edge of the inner annular wall and the bottom edge of the handling portion and wherein the inner annular wall is radially internal to the guarantee seal and the handling portion is radially external to the guarantee seal.

16. A closing device for use with a container, the closing device comprising:

a coupling portion configured to be coupled to the container; and a cap removably attached to the coupling portion and configured to be disconnected upon rotation relative to the coupling portion, the cap including, an inner annular wall extending from a lower edge to an upper edge, a closing bottom at the upper edge to close the inner annular wall, a handling portion suitable to be grasped by a user to disconnect the cap from the coupling portion, the handling portion extending from a bottom edge to a top edge, the handling portion extending annularly about and radially spaced from the inner annular wall, the bottom edge of the handling portion being coplanar with the lower edge of the inner annular wall, and a guarantee seal extending from an upper guarantee seal edge to a lower guarantee seal edge having, at least one engagement element having a vertically extending engagement face extending substantially from the upper guarantee seal edge toward the lower guarantee seal edge and configured to rotationally engage a resistant element of the coupling portion, at least one bridge connecting adjacent portions of the guarantee seal and configured to break upon the vertically extending engagement face of the at least one engagement element rotationally engaging the resistant element of the coupling portion, and a safety portion connecting the inner annular wall to the guarantee seal to retain the guarantee seal such that the guarantee seal remains attached to the cap upon breaking of the bridge.

17. The closing device of claim 16, further comprising at least one tongue connecting the handling portion to the inner annular wall.

18. The closing device of claim 16, wherein the guarantee seal extends below the lower edge of the inner annular wall and the bottom edge of the handling portion and wherein the inner annular wall is radially internal to the guarantee seal and the handling portion is radially external to the guarantee seal.

19. The closing device of claim 16, further comprising the container, wherein the container is deformable.

20. A container assembly, comprising:

a deformable container;

a coupling portion extending from the container and having at least one resistant element; and a cap removably attached to the coupling portion and configured to be disconnected upon rotation relative to the coupling portion, the cap including, an inner annular wall extending from a lower edge to an upper edge, a closing bottom at the upper edge to close the inner annular wall, a handling portion suitable to be grasped by a user to disconnect the cap from the coupling portion, the handling portion extending from a bottom edge to a top edge, the handling portion extending annularly about and radially spaced from the inner annular wall, at least one tongue connecting the handling portion to the inner annular wall, and a guarantee seal extending from an upper guarantee seal edge to a lower guarantee seal edge having, at least one engagement element having a vertically extending engagement face extending substantially from the upper guarantee seal edge toward the lower guarantee seal edge and configured to rotationally engage the at least one resistant element of the coupling portion to prevent the rotation of the guarantee seal upon the vertically extending engagement face of the at least one engagement element rotationally engaging the at least one resistant element at least upon a first opening of the cap, at least one bridge connecting adjacent portions of the guarantee seal and configured to break upon the vertically extending engagement face of the at least one engagement element rotationally engaging the resistant element of the coupling portion, and a safety portion connecting the inner annular wall to the guarantee seal to retain the guarantee seal such that the guarantee seal remains attached to the cap upon breaking of the bridge.

21. A closing device for use with a container, the closing device comprising:

a coupling portion configured to be coupled to the container, the coupling portion including at least one rotational resistant element; and a cap removably attached to the coupling portion, the cap including, an inner annular wall extending from a lower edge to an upper edge, the inner annular wall being open at the lower edge and closed off at the upper edge by a closing bottom, and the inner annular wall being internally threaded to allow for screwing and unscrewing of the cap on and off the coupling portion, a handling portion extending from a bottom edge to a top edge, the handling portion extending annularly about the inner annular wall such that the handling portion is spaced radially outward of the inner annular wall, a plurality of tongues extending outwardly from the inner annular wall to the handling portion to connect the inner annular wall to the handling portion, a plurality of safety passages circumferentially positioned between the tongues that extend radially between the inner annular wall and the handling portion, and a guarantee seal extending from an upper guarantee seal edge to a lower guarantee seal edge having, at least one engagement element having a vertically extending engagement face extending substantially from the upper guarantee seal edge toward the lower guarantee seal edge and configured to rotationally engage the at least one rotational resistant element of the coupling portion to resist the rotation of the guarantee seal upon the vertically extending engagement face of the at least one rotational engagement element rotationally engaging the at least one rotational resistant element at least upon a first opening of the cap, at least one bridge connecting adjacent portions of the guarantee seal and configured to break upon the vertically extending engagement face of the at least one engagement element rotationally engaging the at least one resistant element of the coupling portion, and at least one safety portion extending between the inner annular wall and the guarantee seal to retain the guarantee seal such that the guarantee seal remains attached to the cap upon breaking of the bridge.

22. The closing device of claim 21, wherein the inner annular wall is radially internal to the guarantee seal and the handling portion is radially external to the guarantee seal.

23. The closing device of claim 22, wherein the at least one safety portion extends radially outwardly from the lower edge of the inner annular wall to the guarantee seal.

24. The closing device of claim 23, wherein the guarantee seal extends below the lower edge of the inner annular wall and the bottom edge of the handling portion, and the lower edge of the inner annular wall is coplanar with the bottom edge of the handling portion.

25. The closing device of claim 21, wherein at least part of the coupling portion is tubular in shape and is sealed by the closing bottom of the cap.

26. The closing device of claim 25, wherein the plurality of safety passages are positioned radially outward of the coupling portion and the closing bottom of the cap.

27. The cap of claim 3, wherein the tongue extends generally radially from the inner annular wall to the handling portion and the safety portion is integral with the tongue.

28. The cap of claim 3, wherein the safety portion further includes a reinforcing element extending between the guarantee seal and the tongue.

* * * * *